United States Patent [19]

Lombard

[11] 4,026,224

[45] May 31, 1977

[54] SLUDGE INCINERATOR

[75] Inventor: William K. Lombard, Weston, Canada

[73] Assignee: Trecan Limited, Canada

[22] Filed: Jan. 12, 1976

[21] Appl. No.: 648,321

[52] U.S. Cl. ..... 110/8 C; 110/10

[51] Int. Cl.$^2$ ..... F23G 5/12

[58] Field of Search ..... 110/7 R, 8 R, 8 C, 10; 122/2

[56] References Cited

UNITED STATES PATENTS

| | | | |
|---|---|---|---|
| 1,973,697 | 9/1934 | Bailey | 110/8 |
| 1,973,705 | 9/1934 | Hardgrove et al. | 110/10 |
| 3,344,758 | 10/1967 | Wotschke | 110/8 |
| 3,489,110 | 1/1970 | Miller | 122/2 |
| 3,559,597 | 2/1971 | Heiny | 110/10 |

*Primary Examiner*—Kenneth W. Sprague

*Attorney, Agent, or Firm*—Stevens, Davis, Miller & Mosher

[57] ABSTRACT

An incinerator for pasty or sludge-like wastes includes a fixed hearth within its combustion chamber defining a surface for the burning thereon of a layer of the waste material. The surface of the hearth is sloped downwards toward an ash receiving region to provide for movement of the burning waste materials which are introduced through waste inlet ports. The hearth has a downward slope which progressively increases towards said ash receiving region thereby to compensate for the gradually increasing consistency of the burning materials and thus provide for their continued movement over the hearth surface under the influence of the gravitational forces thereon. The furnace also includes means for providing a rotating flow of burning gases and combustion air within the chamber thereby to ignite and support the combustion of the sludge on the hearth surface.

9 Claims, 4 Drawing Figures

SLUDGE INCINERATOR

This invention relates to the incineration of pastry or sludge-like wastes.

It is well known that various difficulties arise in the combustion of wastes which are in a pasty condition in their natural state or which become pasty under the action of heat. A major problem is that pasty wastes tend to "hang up" or stick to the grate or hearth on which they are supported during combustion. Certain prior art incinerators for use in this connection include a hearth in the form of an inclined rotary drum lined with refractory material, with the combustion material being fed in at the upper end of the drum and ignited in some suitable manner. By rotating the drum, the pasty waste material is conveyed in the direction of the downward slope with the cylindrical inner surface of the drum supporting the burning waste materials. The residue or ash is removed at the lower end of the drum. The combustion air is introduced axially at one end of the drum while the flue gases leave at the other end. Another prior art device involves the use of an inclined trough-like hearth which is rocked to and fro to convey the pasty burning wastes along the longitudinal axis of the trough while supplying combustion air thereto, the ash being removed at the lower end of the trough.

The movable hearth arrangements of the prior art require complex support structures and the devices for moving the heavy grates are both costly and require considerable maintenance.

A prime object of the present invention is to provide an incinerator for sludge-like or pasty wastes employing a fixed hearth which is shaped and arranged in a unique fashion to compensate for the gradually increasing consistency of the burning wastes and the resulting increasing resistance to movement of same over the hearth surface and thus allow for continual travel of such wastes over the hearth under the influence of gravitational forces thereon.

Thus, the invention provides, in one aspect, an incinerator for pasty or sludge-like wastes which includes means defining an enclosed combustion chamber, said chamber having a fixed hearth defining a surface for the burning thereon of a layer of the waste material. Means are provided adjacent the hearth surface defining a waste inlet region and means are disposed at said region for introducing a layer of the waste material on to the surface of the hearth. An ash receiving region is spaced from said waste inlet region. The surface of the hearth is sloped downwardly toward said ash receiving region to provide for movement of the burning waste materials toward said ash receiving region under the influence of gravitational forces thereon, with the downward slope of said surface increasing toward said ash receiving region such as to compensate for the gradually increasing consistency of the burning materials and the consequent increasing resistance to movement thereof over said surface and to provide for their continued movement over the hearth surface.

In a further aspect said surface of the hearth defines a generally shallowly curved burning zone extending from the waste inlet region and a more sharply curved ash fall-off zone between the burning zone and the ash receiving region.

In a further aspect the hearth surface defines a generally continuous curve from said waste inlet region to said ash receiving region with the downward slope of such curve increasing continuously from the waste inlet region to the ash receiving region.

In a further aspect the incinerator further includes burner means associated with said combustion chamber for supplying burning gases to said chamber to assist in the combustion of said waste materials and means for supplying combustion air to support the combustion of the sludge arranged such that said combustion air is preheated by said burning gases and then sweeps across said waste materials which are burning on the hearth surface.

Further aspects of the invention are set forth in the claims appended hereto.

In drawings which illustrate, by way of example, an embodiment of the invention:

Figure 1:
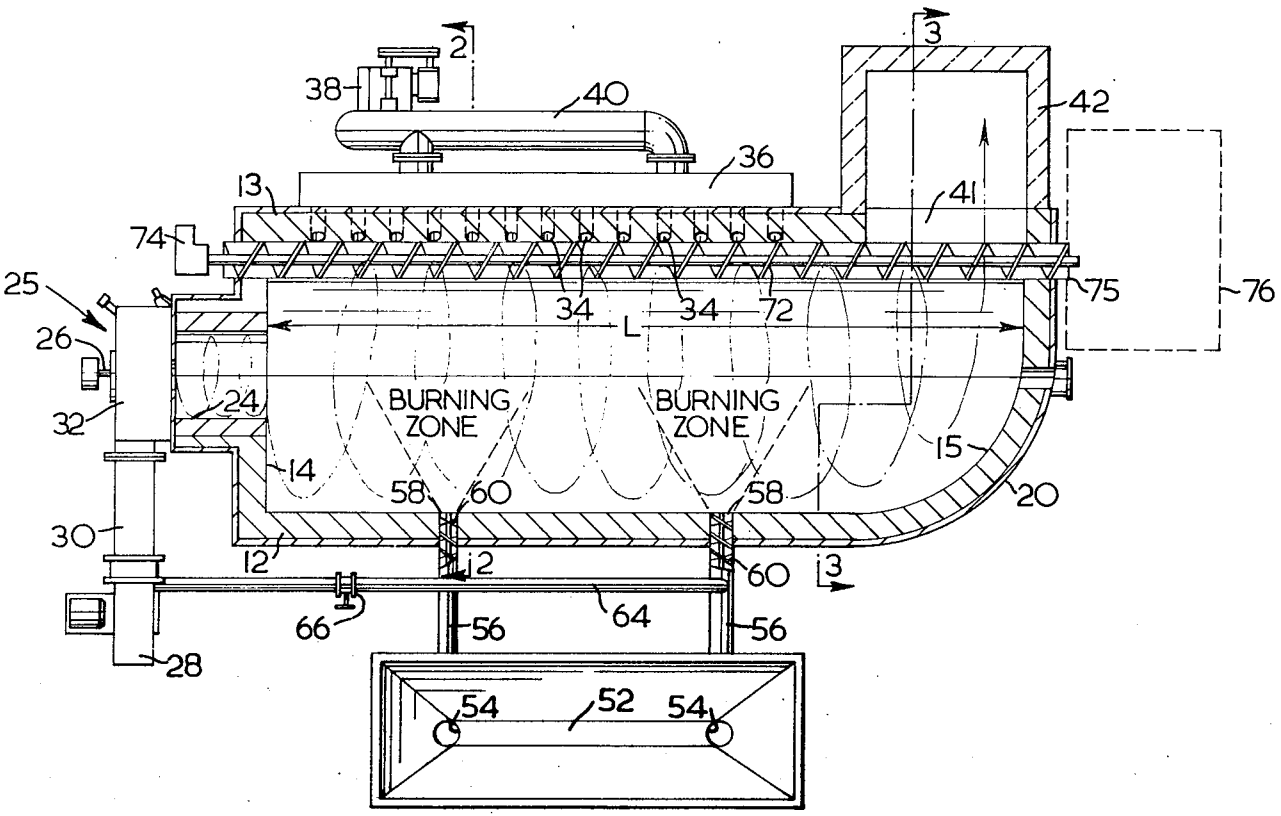
FIG. 1 is a plan section view, taken along line 1—1 of FIG. 2, of an incinerator incorporating the invention.

The incinerator 10 includes an elongated enclosed combustion chamber defined by spaced side walls 12 and 13, opposed end walls 14, 15 (end wall 15 being smoothly curved to merge with sidewall 12), a curved generally semi-circular roof 16, and a floor or hearth 18. The combustion chamber, including the hearth, is made of a suitable conventional refractory material with the roof, side and end walls having a protective cladding layer 20 on the exterior thereof. The incinerator has a support framework 22 thereunder which serves, among other things, to support the hearth 18.

Figure 2:
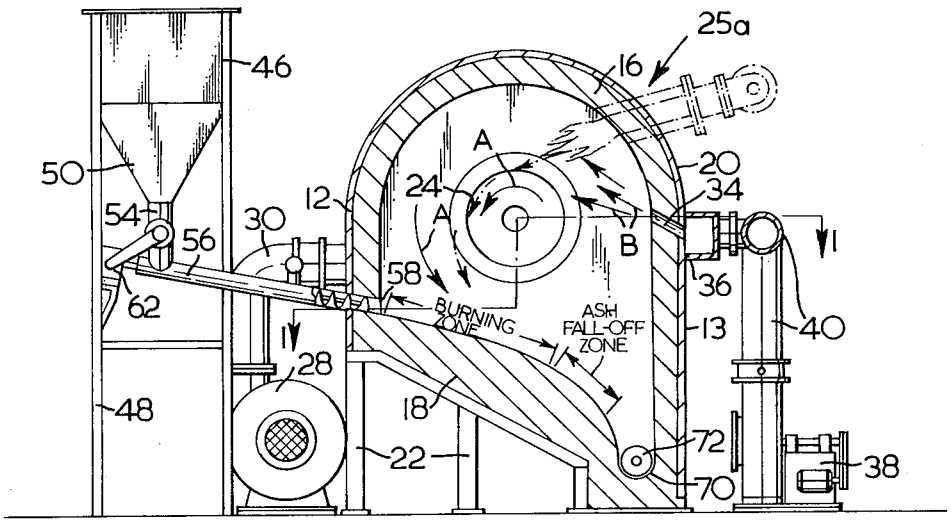
FIG. 2 is an elevational section view taken along line 2—2 of FIG. 1.

As seen in FIGS. 1 and 2, there is disposed in the end wall 14, a cylindrical port 24 having mounted therein a so-called "vortex" burner 25 of any suitable commercially available variety as, for example, a type LV-10 Vortex Burner as manufactured by Trecan Limited, Mississauga, Ontario, Canada, and shown in Canadian Pat. No. 657,224 issued Feb. 5, 1963 corresponding to U.S. Pat. No. 3,042,105 issued July 3, 1962. As is well known in the art, in a vortex burner, fuel is introduced through an inlet 26 leading to a spray nozzle at the centerline of the burner. Combustion air supplied by blower 28 passes through duct 30 tangentially into an annular chamber 32 of the burner and passes through swirl vanes which impart a high rotational velocity to the air. A twisting high velocity vortex action results in complete mixing of the air with the fuel spray at its point of injection. As the highly turbulent air-fuel mixture enters the flame zone, the mixture is preheated, vaporized and raised to ignition temperature almost instantaneously. The flame rotates tangentially within the combustion chamber as shown by arrow A in FIG. 2.

Combustion air to support the combustion of sludge on hearth 18 is supplied through a series of inwardly and upwardly inclined ports 34 located in and spaced along furnace side wall 13. These ports are supplied with combustion air via a plenum chamber 36 sealingly attached to side wall 13, which chamber 36 is supplied with air from blower 38 via ducts 40. Because of the inwardly and upwardly inclined arrangement of ports 34, the air passing therethrough, (illustrated by arrows B), mixes with and complements the rotation of the burner flame, with the burner flame thus preheating the sludge combustion air before it sweeps over the surface of the hearth, thus providing turbulence and a good supply of combustion air immediately above the hearth surface and assuring accelerated combustion of the material on the hearth surface. It is important that the combustion air be supplied in the manner described above in order to enhance the above noted rotary motion of the gases and to provide for the preheating of the combustion air. The rotary motion of the gases is further enhanced by the curved roof line while the curved end wall 15 which merges with the curved roof 16 reduces turbulence in the region of exit of the gases from the combustion chamber. The flue gases escape from the combustion chamber through exit port 41 and pass into a cooling tower 42, which may be of conventional construction, with the cooled gases then passing through a cyclone separator (not shown) which removes particulate materials in the usual fashion. The separator is, in turn, connected to an induced draft fan (not shown) with the outlet of the fan being connected to an exhaust stack (not shown) of suitable size and height.

An alternative form of burner 25*a* is illustrated in dashed lines in FIG. 2 which may be used in place of the vortex burner 25. The burner illustrated is of the short-flame-high heat release type well-known per se in the art and is disposed so that it projects through roof 16 just above the ports 34 in side wall 13 and closely adjacent the end wall 14. The burner is angularly arranged to produce a rotational movement of the burning gases in the combustion chamber as illustrated by the arrows (in dashed lines). In a typical installation the burner 25*a* would operate under 10 to 20% excess air supplied from a blower and would produce a high velocity (300 to 500 feet per second) stream of burning gases thereby to supply the necessary rotational energy and good mixing with and preheating of the combustion air supplied through ports 34 prior to passage of the gases over the hearth in much the same manner as described above in connection with the vortex burner 25.

The sludge-like materials are supplied to the combustion chamber by a system which includes a sludge hopper 46 mounted on a framework 48 in spaced relation to combustion chamber side wall 12. The lower side walls 50 of hopper 46 slope inwardly and downwardly with the narrow bottom portion 52 of the hopper being provided with spaced exit ducts 54, each of which is connected to one end of an associated downwardly inclined feed pipe 56. The opposing ends of feed pipes 56 are connected to the incinerator wall 12 and extend part way through feed ports 58 provided therein. Feed ports 58 terminate immediately above the upper surface of that portion of hearth 18 which is adjacent side wall 12. In order to carry the wastes through feed pipes 56, each has positioned therein a feed screw 60, the feed screws 60 being driven in rotation by associated variable speed drives 62 so that the rate of feed may be varied in accordance with the type of sludge being incinerated. To further assist in the movement of the sludge through feed pipes 56, and to cool the feed screws, each of the latter is connected to an air duct 64 which is supplied with pressurized air from burner blower 28. A valve 66 in air duct 64 can be used to regulate the air flow through the same.

After the sludge enters the combustion chamber it spreads out in a thin layer on the hearth surface and passes slowly over the shallowly curved "burning zone" of the hearth as shown in FIGS. 1 and 2. Water in the sludge is evaporated and the volatile materials are gradually burned off, thus causing the consistency of the sludge to increase as it slides or tumbles across the hearth surface under the influence of gravitational forces thereon. In order to accommodate the increasing consistency and in order to prevent the burning material from "hanging up" or lodging on the hearth surface the downward slope of the hearth surface progressively increases as the distance away from the sludge inlets increases. By the time the materials on the hearth have been fully burned they will have reached the relatively sharply downwardly curved "fall-off zone" as shown in FIG. 2. In this region the ashes and non-combustible materials begin to roll rapidly off the hearth surface into an elongated narrow trough 70 formed adjacent the bottom of the combustion chamber and parallel to and closely adjacent side wall 13. The ash trough 70 has a screw feeder 72 disposed therein, screw feeder 72 being rotated by a variable speed drive assembly 74 thereby to carry the ashes etc., outwardly through port 75 in end wall 20 of the incinerator and into an ash receiver 76 (shown in dashed lines).

Figure 3:
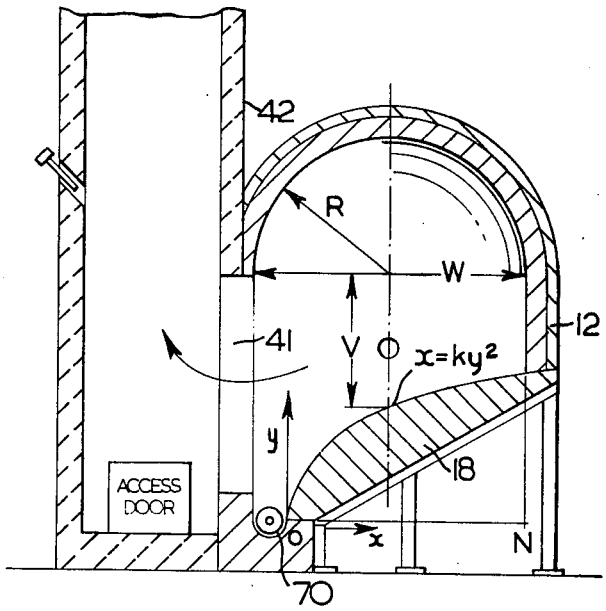
FIG. 3 is a further elevational section view taken along line 3—3 of FIG. 1.

The shape of the hearth surface will vary depending upon the nature of the sludge being incinerated. For very pasty materials, or materials which become very pasty after a short burning time, the hearth surface must have a greater average slope than for materials which are, and remain, relatively free moving during the combustion process. The shape of the hearth upper surface, as seen in transverse cross-section, is preferably in the form of a parabolic curve as represented by the formula $x = ky^2$ with $k$ being a constant which is primarily related to the type of sludge being incinerated. With reference to FIG. 3, the hearth 18 is shown in transverse cross-section, with $x$ and $y$ co-ordinates applied thereto, the $x$ axis being horizontally disposed and the $y$ axis being vertically disposed, the $x$ and $y$ axes crossing and having their origin at point 0 located in trough 70. The upper surface of the hearth 18 is shown as following the mathematical curve $x = ky^2$.

Typical approximate values of $k$ for several sludge compositions as determined under similar conditions are given below. These values will serve as a guide to those skilled in the art. It should be appreciated that these $k$ values are subject to variation depending on the selected "burning time" or "residence time" for the sludge, as well as certain other dimensional factors as will become apparent hereinafter.

TABLE

| | Type of Sludge | Typical Composition Weight % | | "k" value |
|---|---|---|---|---|
| 1. | Ship Ballast Tanks sludge or sludge from shore holding tanks for petroleum products | Water | 40% | 0.1 |
| | | Oil | 10% | |
| | | Organic Solids | 15% | |
| | | Inorganic Solid | 35% | |
| 2. | Sewage Sludge (Activated) | Water | 88% | 0.06 |
| | | Oil | — | |
| | | Organic Solids | 6% | |
| | | Inorganic Solid | 6% | |
| 3. | API (American Petroleum Institute) Separator Sludge | Water | 67% | 0.7 |
| | | Oil | 15% | |
| | | Organic Solids | 6% | |
| | | Inorganic Solid | 13% | |

Figure 4:
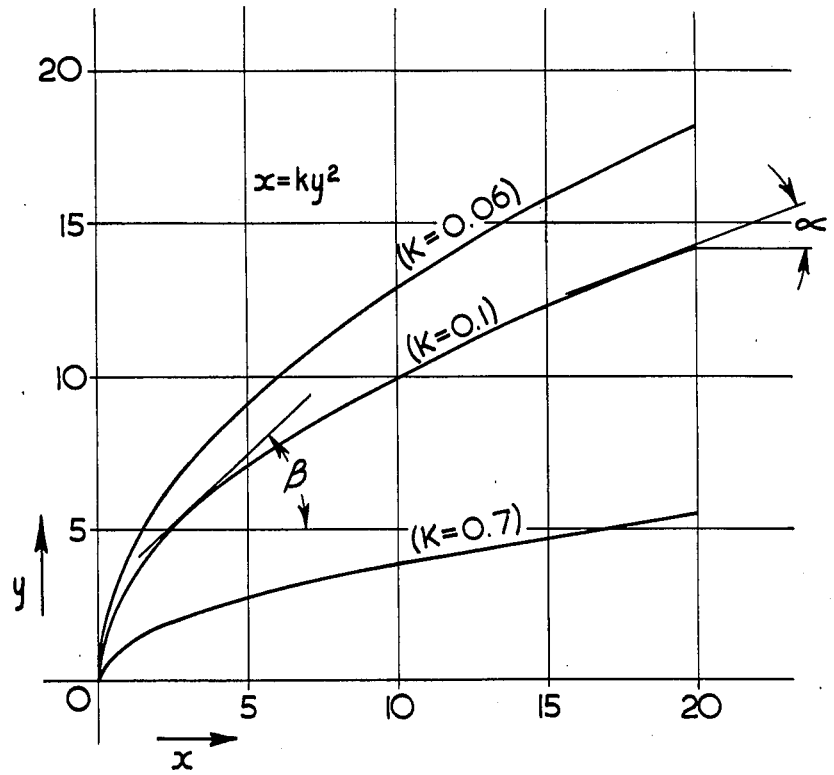
FIG. 4 is a graph showing typical parabolic curves defining the shape of the floor or hearth of the incinerator.

FIG. 4 shows a series of curves for each of the $k$ values given above plotted for values of $x$ between 0 and 20. For practical purposes, in any given furnace, the horizontal distance from point 0 to point N as seen in FIG. 3 is generally broken up into about 20 intervals for purposes of establishing the limits of the mathematical curve. All of the curves shown have similar characteristics in that each curve is of relatively shallow curvature at higher values of $x$. This region of shallow curvature corresponds to the "burning zone" of the hearth as described previously. As $x$ becomes smaller, the slope of each curve progressively increases until a point is reached on each curve which corresponds to the start of the above noted "ash-fall off zone," with the slope of each curve approaching the vertical as $x$ approaches zero.

With reference to FIG. 4 it will be seen that as $k$ increases, the average slopes of the curves decrease. Hence, the more fluid or freely flowable the sludge the higher the $k$ value, all other factors being equal. With reference to the Table, it will be seen that activated sewage sludge has the lowest of any of the $k$ values given, i.e. 0.06. This type of sludge is relatively "pasty" in nature. It is believed that the water tends to be quite intimately mixed, absorbed or combined with the organic and inorganic solids thus accounting for its pasty nature and for the low $k$ value associated with it. On the other hand, API (American Petroleum Institute) separator sludge, which is sludge derived from a separator well known per se and used in oil refineries to separate water from oil wastes, tends to be relatively freely flowable thus accounting for the high $k$ value associated with it. The Ships Ballast tank type sludge, (item 1 in the Table), behaves quite differently from the separator sludge; it appears that the oil and organic solids are not intimately mixed or combined with one another, the net result of which is that this material calls for a much lower $k$ value than does the separator sludge, all other conditions being equal.

It will be appreciated that the above approximate $k$ values are for purposes of illustration and comparison only. The composition of any given type of sludge will vary somewhat from day to day in any actual operation; therefore, the $k$ value to be used in constructing the incinerator will be selected to reflect the average sludge composition which the incinerator will be expected to handle.

The determination of a suitable $k$ value for any particular type of sludge will require a small amount of trial and error experiment. The $k$ value determination will also involve a consideration of the "residence time" i.e., the time for the sludge to burn substantially fully as it moves from the sludge inlets to the ash fall-off zone. The "residence time," as is well known in the art, is a function of the burner flame temperature, the degree of turbulence provided by the sludge combustion air and is also a function of the sludge feed rate i.e., a fast feed rate will provide a thicker, more slowly burning layer of sludge on the hearth than will a slower rate of feed which produces a thinner layer of sludge on the hearth. The above factors can be varied in any given design to provide a selected "residence time" for the sludge being burned. A residence time of somewhat less than 1 minute is considered to be adequate for most sludges. Let it be assumed that a hearth surface is to be designed for the burning of Ships Ballast Tank Sludge (item 1 of the Table). The "residence time" is selected as being 0.7 minutes. The designer, having regard to the furnace capacity, chooses to make the transverse width dimension W (FIG. 3) of the furnace interior about 6 feet. Therefore, in order to allow room for the ash screw feeder 72, the horizontal distance from $x = 0$ to $x = n$ (See FIG. 3) is selected to be about 5 feet. The designer knows that the hearth must be designed so that, in operation, the sludge will travel along the hearth surface from the sludge inlets to the start of the ash fall-off zone in about 0.7 minutes. The distance along the hearth from the sludge inlets to the ash fall-off zone is not known exactly because the shape and slope of the curve is not known at this point, but the designer selects a reasonable distance, say, about 5 feet, as being a rough approximation. The selection of this distance is facilitated by the use of a graph drawn to a suitable scale and having a family of $x = ky^2$ curves plotted thereon for different values of $k$ in a manner similar to that shown in FIG. 4. In the example given, the designer has selected the horizontal distance from $x = 0$ to $x = 20$ as being 5 feet. All of the curves shown have their regions of sharpest curvature at values of $x$ less than 5. Thus, it is reasonable for him to assume that the ash fall-off zone will be at a point on one of the curves somewhere between $x = 0$ and $x = 5$. The average distance as measured to scale along the several curves from $x = 20$ to a point between $x = 0$ and $x = 5$ will be found to be about 5 feet.

The designer then places a "raw" or unburned sample of the sludge on a flat surface having roughness characteristics approximating those of the hearth which he is designing and tilts the surface from the horizontal until the sludge flows at a rate fast enough to travel the estimated distance of 5 ft. in 0.7 minutes (approximately 7 ft/minute). The angle of tilt of the surface required to produce this rate of travel is then meausred. The measured angle of tilt ($\alpha$) to the horizontal will correspond approximately to the required slope of the hearth at the sludge entrance region and will correspond approximately to the slope of the curve $x = ky^2$ at $x = 20$ (See FIG. 4) assuming that the 5 ft. distance estimated is approximately correct. The approximate value of $k$ in the formula $x = ky^2$ is then determined by applying the measured slope angle $\alpha$ to the above noted family of curves of the $x = ky^2$ variety plotted for a wide variety of different values of $k$ and selecting that curve which has the measured slope angle at $x = 20$. (The slope angle is shown in FIG. 4 for purposes of illustration). In this fashion the approximate value of $k$ may be determined and, in this instance, the value of $k$ was found to be 0.1. It will be realized that the test outlined above wherein the slope angle of a flat surface required to produce travel of the unburned sludge a selected distance in a selected time simulates the actual conditions existing in the incinerator only at the sludge entrance zone, i.e., before the sludge consistency increases during the burning process. However, it has been found that the test yields results sufficiently accurate as to enable those skilled in the art to put the invention into practice. The downwardly increasing slope of the parabolic curve determined by the test compensates for the gradually increasing consistency of the burning sludge sufficiently as to provide for travel of the burning sludge thereover at an average rate in accordance with the selected residence time. This method for determining the value of $k$ also has a built-in safety factor in that, under actual conditions in the furnace, the rate of movement of the burning sludge will, if anything, decrease slightly as it spreads out and its consistency increases during the burning process, thus reducing the possibility of the furnace being designed with an inadequately dimensioned burning zone.

The designer will also test a sample of the fully burned sludge, i.e., the ash or residue, in order to determine the approximate slope required for the ash to slide or fall off the hearth surface. The angle of tilt $\beta$ is applied as a tangent to the curve as selected above as a check to ensure that the slope of the curve at the estimated ash fall-off point (which was estimated above to be about 5 feet from the inlets) is just sufficient as to ensure proper fall-off of the ash or residue. (The angle of tilt $\beta$ is also shown in FIG. 4 for purposes of illustration). If the actual slope of the curve at the estimated ash fall-off point does not correspond approximately to the measured angle of tilt $\beta$ the designer will know that he has incorrectly estimated the distance along the curve from the sludge inlets to the ash fall-off zone in which event he will adjust his estimated distance slightly and repeat the simple experiments described above until he has selected a curve of the $x = ky^2$ variety which provides the desired slopes at the sludge inlet region and the ash fall-off zone for the particular sludge in question and the selected resident time.

The $k$ values given in the Table for activated sewage sludge and API separator sludge were determined under essentially the same conditions as described above; the assumed "residence time" in both cases was 0.7 minutes.

In a typical furnace as shown in the drawings the combustion chamber length dimension L (See FIG. 1) was about 16 ft. The inside width dimension W was 6 ft; the radius R of the roof was 3 ft; and the distance from the point $x = 0$ to $x = n$ was about 5.0 ft., and dimension V was about 3 ft. (See FIG. 3). The remaining dimensions of the various components of the furnace are not given as these can readily be determined by the man skilled in the art in the light of the above disclosure and the drawings. The hearth surface shown in FIG. 3 was shaped in accordance with the formula $x = ky^2$ as described above, with a $k$ value of 0.1 for values of $x$ from 0 to 20. Typical operating conditions for the furnace dimensioned as described above are as follows: (The sludge is Ship Ballast Tank sludge as described in item 1 of the Table).

| | | |
|---|---|---|
| 1) | Sludge feed rate | 3000 lbs./hr. |
| 2) | Combustion air feed to vortex burner | 5500 lbs./hr |
| 3) | Fuel feed rate to vortex burner (Heating value of oil or gas feed) | 6.5 million BTU/hr. |
| 4) | Combustion air for sludge burning (supplied through ports 34) | 8700 lbs./hr. |
| 5) | Excess Air: | |
| | Vortex burner | 15% |
| | Sludge burning (supplied through ports 34) | 100% |
| 6) | Burner flame temperature | 2600 – 3000° F. |
| 7) | Flue gas temperature (entrance to cooling tower) | 2000° F. |

The shape of the hearth surface, for any given design, preferably remains substantially constant all along the length of the combustion chamber. However, those skilled in the art will realize that those portions of the hearth surface removed from the burning zone, e.g., at the extreme end portions of the chamber, may be somewhat differently shaped in the event that this different shaping is required to accommodate certain features of construction present in the design.

It will be realized by those skilled in the art that the shape of the hearth need not be strictly limited to mathematical curves of the $x = ky^2$ variety described above. Other forms of curves may be acceptable so long as their characteristics parallel the characteristics of the curves described above. That is, the curve selected must provide for a downward slope which increases as the distance away from the sludge inlets increases thereby to compensate for the gradually increasing resistance to movement of the burning wastes over the hearth resulting from the gradually increasing consistency of the burning wastes.

Those skilled in the art will appreciate that the structure described above does not require the use of moving parts within the combustion chamber except for the ash removal screw 72. Since there is a minimum of moving parts within the combustion chamber both initial costs and maintenance costs are kept to a minimum. Furthermore, since the sludge is burned on the hearth surface, there is a minimum of particulate carryover in the flue gases thus reducing the efficiency requirement and thus the cost of the flue gas clean-up equipment.

I claim:

1. An incinerator for pasty or sludge-like wastes comprising: means defining an enclosed combustion chamber, said chamber including a fixed hearth defining a surface for the burning thereon of a layer of the waste material, means adjacent the hearth surface defining a waste inlet region and means at said region for introducing a layer of the waste material on to the surface of the hearth, an ash receiving region spaced from said waste inlet region, and wherein said surface of the hearth is sloped downwardly toward said ash receiving region to provide for movement of the burning waste materials toward said ash receiving region under the influence of gravitational forces thereon, the hearth surface as seen in transverse cross-section defining a generally continuous curve from said waste inlet region to said ash receiving region with the downward slope of such curve increasing generally continuously from the waste inlet region to the ash receiving region to compensate for the gradually increasing consistency of the burning materials and the consequent increasing resistance to movement thereof over said surface and to provide for their continued movement over the hearth surface.

2. The incinerator according to claim 1 wherein said curve is generally in the form of a parabola.

3. The incinerator according to claim 1 further including burner means associated with said combustion chamber for supplying burning gases to said chamber to assist in the combustion of said waste materials, and means for supplying combustion air to support the combustion of the sludge arranged such that said combustion air is heated by said burning gases and then sweeps across said waste materials which are burning on the hearth surface.

4. The incinerator according to claim 3 wherein said burner means is arranged to provide a rotating stream of burning gases within the combustion chamber above said hearth with said combustion air supply means being adapted to introduce the combustion air into the combustion chamber in such a way as to join said burning gases and complement the rotating motion thereof, with said combustion air being thereby preheated by said burning gases.

5. The incinerator according to claim 4 wherein the burner means and the combustion air supply means are arranged such that the rotating gases sweep directly over the burning wastes on said hearth to assist in the rapid combustion thereof.

6. The incinerator according to claim 1 wherein said ash receiving region has ash conveyance means associated therewith for removing ashes from the incinerator.

7. An incinerator for pasty or sludge-like wastes comprising: means defining an enclosed combustion chamber, said chamber including a fixed hearth defining a surface for the burning thereon of a layer of the waste material, means adjacent the hearth surface defining a waste inlet region and means at said region for introducing a layer of the waste material on to the surface of the hearth, an ash receiving region spaced from said waste inlet region, and wherein said surface of the hearth is sloped downwardly toward said ash receiving region to provide for movement of the burning waste materials toward said ash receiving region under the influence of gravitational forces thereon, with the downward slope of said surface increasing toward said ash receiving region such as to compensate for the gradually increasing consistency of the burning materials and the consequent increasing resistance to movement thereof over said surface and to provide for their continued movement over the hearth surface, burner means associated with said combustion chamber for supplying burning gases to said chamber to assist in the combustion of said waste materials, means for supplying combustion air to support the combustion of the sludge arranged such that said combustion air is heated by said burning gases and then sweeps across said waste materials which are burning on the hearth surface, and wherein said burner means is arranged to provide a rotating stream of burning gases within the combustion chamber above said hearth with said combustion air supply means being adapted to introduce the combustion air into the combustion chamber in such a way as to join said burning gases and complement the rotating motion thereof, with said combustion air being thereby preheated by said burning gases.

8. The incinerator according to claim 7 wherein the burner means and the combustion air supply means are arranged such that the rotating gases sweep directly over the burning wastes on said hearth to assist in the rapid combustion thereof.

9. The incinerator according to claim 7 wherein said ash receiving region has ash conveyance means associated therewith for removing ashes from the incinerator.

* * * * *